United States Patent [19]

Perkins et al.

[11] 4,142,535

[45] Mar. 6, 1979

[54] SMOKING PRODUCT

[75] Inventors: Paul R. Perkins, Portishead; Christopher R. Bale, Bristol, both of England

[73] Assignee: Imperial Group Limited, London, England

[21] Appl. No.: 849,429

[22] Filed: Nov. 7, 1977

Related U.S. Application Data

[63] Continuation of Ser. No. 682,954, May 4, 1976, abandoned.

[51] Int. Cl.[2] ..... A24B 3/14

[52] U.S. Cl. ..... 131/17 AC

[58] Field of Search ..... 131/2, 17, 15, 140

[56] References Cited

U.S. PATENT DOCUMENTS

| | | | |
|---|---|---|---|
| 2,592,554 | 4/1952 | Frankenburg | 131/17 A |
| 3,424,169 | 1/1969 | Moren | 131/140 C |
| 3,529,602 | 9/1970 | Hind et al. | 131/2 |
| 3,710,805 | 1/1973 | Tamaki et al. | 131/140 C |
| 3,746,012 | 7/1973 | Deszyk | 131/140 P |
| 3,861,400 | 1/1925 | Perkins et al. | 131/144 |

OTHER PUBLICATIONS

The Pectic Substances by Kertesz, Published 3/1951, Published by Interscience Publishers, Inc., N.Y. (USA), pp. 163–167.

*Primary Examiner*—Robert W. Michell
*Assistant Examiner*—V. Millin
*Attorney, Agent, or Firm*—Larson, Taylor and Hinds

[57] ABSTRACT

A smoking product comprising tobacco including as a film-forming or binding agent a pectin having a degree of methylation between 30% and 75% and an inherent viscosity between 2 and 6.5 deciliters per gram.

7 Claims, No Drawings

SMOKING PRODUCT

This is a continuation, of application Ser. No. 682,954 filed 5/4/76 now abandoned.

This invention concerns a smoking product, e.g. a cigarette, hand rolling tobacco, pipe tobacco, cigar or cigarillo containing tobacco and non-tobacco substances.

It is an object of the present invention to provide a smoking product having a higher filling value than a tobacco smoking product, such as flue-cured Virginia tobacco blends, containing no additive.

It is a further object of the invention to provide a smoking product containing tobacco and non-tobacco additives which contains nicotine in a stable form at a level similar to that in conventional tobacco blends.

Small particle size and high sand content tobacco offals have hitherto proved difficult to reconstitute into sheet having acceptable physical properties. It is yet a further object of the invention to overcome this difficulty.

Tobacco, in the context of the invention, includes a tobacco lamina, midrib, main stalk or tobacco offals, and tobacco extracts.

Hitherto, increased filling power of tobacco has only been satisfactorily achieved by physical/mechanical methods. It will be shown herein that an increased filling power over that of conventional flue-cured Virginia tobacco blends may be achieved by means of a suitable composition of matter containing tobacco and other substances in specified quantities, without recourse to physical or mechanical methods.

According to the present invention there is provided a smoking product comprising tobacco and non-tobacco additives, the additives including as a film-forming or binding agent a pectin having a degree of methylation between 30% and 75% and an inherent viscosity between 2 and 6.5 deciliters per gram, the proportions of tobacco and additives by weight being 5–60% and 40–95% respectively.

"Inherent viscosity" is defined by the equation, $$V_i = 1/c \ln (V_p/V_s)$$

where $V_i$ is inherent viscosity $V_p$ is the viscosity of the pectin $V_s$ is the viscosity of the solvent (usually water)

and c is the concentration of pectin in solvent — usually 0.1% w/w.

Inherent viscosity is a measure of the molecular weight of a pectin.

The pectin is preferably a slow set citrus pectin having a degree of methylation between 55% and 70% and an inherent viscosity between 3 and 6 deciliters per gram.

The additives may include a nicotine additive, such as nicotine or a nicotine salt, and a water-insoluble inorganic filler, such as a diatomaceous earth or complex silicate, the combination of the pectin and the filler being such that the pH of an aqueous extract of the smoking product is less than 6.5, thereby ensuring stability of nicotine in the smoking product.

The nicotine salt is preferably nicotine pectinate.

The invention will now be described by way of example with reference to the accompanying Tables 1–3. All concentrations and proportions are on a dry-weight basis.

Table 1 sets forth initial concentrations of tobacco and additives slurries for use in the invention.

Table 2 sets forth the proportions in which the slurries of Table 1 are mixed to give additive sheets containing different percentages of tobacco.

Tables 3A and 3B set forth comparative analyses and smoking properties of cigarettes made from (a) the additive sheets of Table 2, (b) tobacco extracts incorporating the compositions of Table 1, (c) sheet tobacco containing no additives, and (d) a tobacco control.

The types of tobacco sheet identified in Tables 2 and 3 are as follows:

Type A Containing 5% tobacco, and made from tobacco offals or dust

Type B Containing 10% tobacco, and made from tobacco offals or dust

Type C Containing 20% tobacco, and made from tobacco offals or dust

Type D Containing 40% tobacco, and made from tobacco offals or dust

Type E Containing 60% tobacco, and made from tobacco offals or dust

Type F Containing 5% tobacco, and made from tobacco extract

Type G Containing 10% tobacco, and made from tobacco extract

Type H Containing 20% tobacco, and made from tobacco extract

Type NTS Containing 100% tobacco, and containing no additive

Type TC in Table 3 is a control cigarette made from conventional flue-cured Virginia tobacco blends.

Referring to Tables 1 and 2, flue cured high silica tobacco dust (offal) was formed into a slurry with water to give a solid content of 7.8% w/w. This was passed through a Spout-Waldron refiner and then twice through a Manton Gaulin K'3 homogeniser at 3000 psi.

The additive part of the product was prepared by dissolving a slow set citrus pectin having a degree of methylation of 55–70% and an inherent viscosity of 3–6 deciliters per gram in water at 50° C. to give a solution of 3.5% w/w and adding a solution/dispersion of calcium hydroxide, potassium carbonate, citric acid, celite (a solid solution of dicalcium aluminate in dicalcium silicate) which is a water-insoluble inorganic filler, and trigol, prepared at the concentration shown in Table 1 and added in the proportions shown in Table 2. The slurry was thoroughly mixed using a Wellmix high shear mixer.

The nicotine fortifying solution was prepared separately according to the concentrations shown in Table 1 and added along with the tobacco slurry to the pectin/inorganic mixture according to the proportions shown in Table 2. The slurry mixes were stirred using a Wellmix high shear mixer and cast on a Sandvik sheet making machine.

It is essential for the long term stability of nicotine in the final product that the pH of an aqueous extract of the final product does not exceed 6.5 and is preferably less than 6. The combination of binding agent and inorganic filler is chosen such that the pH requirement is attained.

The tobacco extracts of Table 3A (types, F, G, H) were prepared by soaking 20lb of a commercial tobacco blend (flue-cured Virginia) in 175lb water for 30 minutes, filtering and re-extracting the tobacco with two portions of 110lb water. The combined extracts were concentrated by two passes through a climbing film evaporator to yield a concentrate containing about 50% solids. The concentrated extract was added to the prepared slurry of pectin and inorganic materials in the proportions listed in Table 2, mixed with a high shear mixer, and cast on a Sandvik sheet forming machine.

The types of sheet obtained by the above methods were cut at 37 cuts per inch on a 8" Legg tobacco cutting machine and made into filter tipped cigarettes on a Molins Mark 8 cigarette making machine. These cigarettes were 70 mm in length and 25.3 mm in circumference and had a 10 mm myriz/6 mm acetate dual filter.

The cigarettes were mechanically smoked on a Filtrona 101 smoking machine to a butt length of 3mm longer than the filter overwrap material using a 35 ml puff of 2 seconds duration once per minute. The smoke condensate collected on a Cambridge glass fibre filter pad was analysed for particulate matter and nicotine by weighing the wet deposit on each filter, analysing the deposit for nicotine content by automated colorimetric analysis (cyanogen bromide method) and analysing the deposit for water content by gas chromatography. The particulate matter (PM) level is thus water and nicotine free.

The cigarettes were also tested for firmness, an important parameter which influences manufacturing economics and consumer acceptability. Cigarette firmness can be described as the degree of flattening under constant compression. The firmness results are given in terms of the Relative Filling Power (RFP) of the filler material and is obtained by dividing the mean density of an experimental cigarette into the density of a control cigarette at the same flattening, and expressing it as a percentage. In this case the control cigarette was a cigarette incorporating a commercially available tobacco blend. Analytical results are shown in Tables 3A and 3B.

TABLE 1

| | | |
|---|---|---|
| 1. | Pectin solution | |
| | Slow set citrus pectin | 3.5% w/w. |

TABLE 1-continued

| | | |
|---|---|---|
| 2. | Inorganic dispersion/solution. | |
| | Calcium hydroxide | 0.6% w/w. |
| | Potassium carbonate | 0.6% w/w. |
| | Celite | 14.7% W/W. |
| | Celite | 14.7% w/w. |
| | Trigol (triethylene glycol) | 2.3% w/w. |
| 3. | Nicotine fortifying solution. | |
| | Low methoxyl pectin | 5.0% w/w. |
| | Nicotine | 1.25% w/w. |
| 4. | Tobacco slurry. | |
| | Flue cured high silica tobacco dust | 7.8% w/w. |

The calcium hydroxide is a pectin cross-linking agent, the potassium carbonate + citric acid is a burn/smoulder control agent, and the trigol is a humectant.

TABLE 2

| Sheet type | A | B | C | D | E | F | G | H |
|---|---|---|---|---|---|---|---|---|
| Constituent | | | | | | | | |
| Slow set citrus pectin solution | 30.87 | 29.25 | 26.0 | 19.5 | 13.0 | 30.87 | 29.25 | 26.0 |
| Inorganic solution/dispersion | 54.63 | 51.75 | 46.0 | 34.5 | 23.0 | 54.63 | 51.75 | 46.0 |
| Nicotine fortifying solution | 9.5 | 9.0 | 8.0 | 6.0 | 4.0 | 9.5 | 9.0 | 8.0 |
| Tobacco slurry | 5 | 10 | 20 | 40 | 60 | 5 | 10 | 20 |

All figures in Table 2 are percentages and are expressed on a dry weight basis of each group of constituents shown in Table 1.

TABLE 3A

| Sheet Type & Tobacco content (%) | A 5 | B 10 | C 20 | D 40 | E 60 | F 5 | G 10 | H 20 | NTS 100 | TC 100 |
|---|---|---|---|---|---|---|---|---|---|---|
| Analysis | | | | | | | | | | |
| pH aqueous extract filler material | 4.92 | 4.92 | 4.50 | 4.70 | 4.94 | 4.93 | 4.95 | 4.92 | 5.44 | 5.40 |
| % Nicotine in sheet | 2.13 | 2.23 | 2.16 | 2.04 | 1.90 | 2.15 | 2.26 | 2.16 | 1.84 | 1.97 |
| Filling value, cc/gm | 7.94 | 7.76 | 7.75 | 6.95 | 6.25 | 7.54 | 7.51 | 6.81 | 4.04 | 4.01 |
| Cigarette weight, gm | 0.627 | 0.654 | 0.785 | 1.006 | 1.031 | 0.645 | 0.696 | 0.668 | 1.005 | 1.102 |
| Mean no. of puffs/cigarette | 3.8 | 4.0 | 5.0 | 5.0 | 6.0 | 4.2 | 4.3 | 4.0 | 6.5 | 9.5 |
| Particulate matter yield, mg/cig | 7.1 | 7.5 | 9.4 | 10.1 | 12.3 | 6.9 | 7.6 | 8.6 | 11.6 | 16.3 |
| Nicotine in smoke, mg/cig | 0.52 | 0.52 | 0.71 | 0.71 | 0.84 | 0.56 | 0.63 | 0.71 | 0.66 | 1.19 |
| Filter retention, % | 59 | 56 | 54.3 | 53.7 | 51.2 | 56 | 54 | 55 | 52.3 | 48.7 |
| Relative filling power (%) | 143 | 132 | 136.0 | 125.9 | 123 | 126 | 125 | 117 | 93.5 | 100 |

TABLE 3B

| | Sheet Type | | | | |
|---|---|---|---|---|---|
| | C | D | E | NTS | TC |
| % Nicotine at sheetmaking | 2.03 | 2.03 | 1.98 | 1.95 | — |
| % Nicotine after 12 weeks storage at 61% relative humidity and 21° C in open containers. | 1.93 | 1.95 | 1.90 | 1.77 | 1.90 |

Alternatively to citrus pectins, having a degree of methylation between 55% and 70% and an inherent viscosity between 3 and 6 deciliters per gram, other pectins may be used, typically beet pectins having a degree of methylation between 30% and 75% and an inherent viscosity between 2 and 6.5 deciliters per gram.

Nicotine salts other than nicotine pectinate may be used, such as nicotine alginate or nicotine citrate.

Instead of celite, the inorganic filler may be a complex silicate such as fullers earth, china clay or bentonite provided the aqueous extract pH of the smoking product incorporating it is less than 6.5 so as to ensure the stability of the nicotine in the product.

It is seen from Table 3 that a smoking product according to the invention has a filling power substantially higher than that of a conventional flue-cured Virginia tobacco blend containing no additive. It follows that less additive sheet filler than tobacco is required to produce cigarettes of equivalent firmness to that of the control. Furthermore, the nicotine in samples of the smoking product of the invention was found to be at least as stable over a period of 3 months as the nicotine in a 100% tobacco sheet or a cigarette made from flue-cured Virginia tobacco blends.

The smoking product was found to be a practicable uitlization of tobacco offals containing a high silica content, giving satisfactory smoking properties.

Furthermore, the additive sheets of the invention yield less particulate (i.e. tar-containing) matter than the conventional tobacco control.

What we claim is:

1. A smoking product in sheet form comprising 5–60% by weight tobacco and 40 to 95% by weight non-tobacco additives, including as a film-forming or binding agent a pectin having a degree of methylation between 30% and 75% and an inherent viscosity between 2 and 6.5 deciliters per gram, whereby the sheet has a substantially greater relative filling power as a measure of firmness when in a cigarette, than the relative filling power of cured Virginia tobacco, said relative filling power, RFP, being defined as:

$$RFP = \frac{\text{mean density of control cigarette}}{\text{mean density of experiment of cigarette}} \text{ at the}$$

2. A smoking product as claimed in claim 1 wherein the pectin is a slow set citrus pectin having a degree of methylation between 55% and 70% and an inherent viscosity between 3 and 6 deciliters per gram.

3. A smoking product as claimed in claim 1 wherein the additives include a nicotine additive and a water-insoluble inorganic filler, the combination of the pectin and the filler being such that the pH of an aqueous extract of the smoking product is less than 6.5, thereby ensuring stability of nicotine in the smoking product.

4. A smoking product as claimed in claim 3 wherein the filler is a complex silicate.

5. A smoking product as claimed in claim 3 wherein the nicotine additive is nicotine or a nicotine salt.

6. A smoking product as claimed in claim 5 wherein the nicotine salt is nicotine pectinate.

7. A smoking product as claimed in claim 1 wherein the proportions of tobacco and additives by weight lie between 10–20% and 80–90% respectively.

* * * * *

UNITED STATES PATENT AND TRADEMARK OFFICE

CERTIFICATE OF CORRECTION

PATENT NO. : 4,142,535

DATED : March 6, 1979

INVENTOR(S) : PERKINS ET AL

It is certified that error appears in the above-identified patent and that said Letters Patent are hereby corrected as shown below:

Claim 1, last line after "at the" in the formula insert ...same compression...

Signed and Sealed this

*Eighteenth* Day of *March 1980*

[SEAL]

*Attest:*

SIDNEY A. DIAMOND

*Attesting Officer*

*Commissioner of Patents and Trademarks*